US010966897B2

(12) United States Patent
Bankowski

(10) Patent No.: US 10,966,897 B2
(45) Date of Patent: Apr. 6, 2021

(54) AUTOMATED WALKER ASSEMBLY

(71) Applicant: Mike Bankowski, Sioux Falls, SD (US)

(72) Inventor: Mike Bankowski, Sioux Falls, SD (US)

( * ) Notice: Subject to any disclaimer, the term of this patent is extended or adjusted under 35 U.S.C. 154(b) by 15 days.

(21) Appl. No.: 16/460,732

(22) Filed: Jul. 2, 2019

(65) Prior Publication Data

US 2021/0000679 A1 Jan. 7, 2021

(51) Int. Cl.
*A61H 3/04* (2006.01)
*A61H 3/00* (2006.01)

(52) U.S. Cl.
CPC ..... *A61H 3/04* (2013.01); *A61H 2003/007* (2013.01); *A61H 2003/043* (2013.01); *A61H 2003/046* (2013.01)

(58) Field of Classification Search
CPC ..... A61H 3/04; A61H 3/00; A61H 2003/007; A61H 2003/043; A61H 2003/046
USPC ..... 180/65.1
See application file for complete search history.

(56) References Cited

U.S. PATENT DOCUMENTS

| | | | | |
|---|---|---|---|---|
| 7,161,322 | B2 | 1/2007 | Want | |
| 8,384,755 | B2 | 2/2013 | Wang | |
| 8,401,275 | B2 | 3/2013 | Wang | |
| 8,790,284 | B2 * | 7/2014 | Jeon | A61H 3/00 601/35 |
| 8,930,019 | B2 | 1/2015 | Allen | |
| 9,186,992 | B2 * | 11/2015 | Katayama | B60K 28/16 |
| 9,271,893 | B2 * | 3/2016 | Knopow | A61H 3/04 |
| 9,323,250 | B2 | 4/2016 | Wang | |
| 9,498,886 | B2 | 11/2016 | Rosenstein | |
| 9,974,612 | B2 | 5/2018 | Pinter | |
| 10,219,969 | B2 * | 3/2019 | Yu | A61H 3/04 |
| 10,292,891 | B2 * | 5/2019 | Zheng | A61F 5/0123 |
| 10,406,061 | B1 * | 9/2019 | January | A61H 1/00 |
| 2005/0216126 | A1 | 9/2005 | Koselka | |
| 2005/0236217 | A1 * | 10/2005 | Koelin | A61G 5/046 180/411 |
| 2007/0192910 | A1 | 8/2007 | Vu | |
| 2008/0084690 | A1 * | 4/2008 | Rappl | F21V 21/0832 362/184 |
| 2017/0128299 | A1 | 5/2017 | Tsusaka | |
| 2019/0262216 | A1 * | 8/2019 | Kanaya | A63B 23/04 |

FOREIGN PATENT DOCUMENTS

| | | |
|---|---|---|
| CN | 107775647 | 3/2016 |

* cited by examiner

*Primary Examiner* — John D Walters

(57) ABSTRACT

An automated walker assembly includes a housing having a perimeter wall with a front side, a rear side, a first lateral side and a second lateral side. A plurality of wheel mounts is attached to the housing and a plurality of wheels is attached to the wheel mounts. A pair of handles is attached to the housing for gripping by a user of the assembly. A plurality of drive assemblies is mounted to the housing to control the housing. The drive assemblies include a propulsion drive mechanically coupled to at least one of the wheels and a direction drive is mechanically coupled to at least one of the wheels to define a directional wheel. The propulsion and direction drives propel the assembly over a ground surface. An interface electrically coupled to each of the drive assemblies selectively actuates each of the drive assemblies.

17 Claims, 7 Drawing Sheets

AUTOMATED WALKER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The invention relates to walker devices used by persons requiring assistance while walking. These devices typically are non-motorized and include a frame with wheels and handles for gripping by a user. However, these devices do not include means for adequately controlling the walking speed or assisting of a person in their movement from a seated to a walking position.

(2) Description of Related Art Including Information Disclosed Under 37 CFR 1.97 and 1.98

The disclosure and prior art relates to walker devices and more particularly pertains to a new walker device with a housing that has a top wall, a bottom wall and a perimeter wall extending between and attached to the top and bottom walls. The perimeter wall has a front side, a rear side, a first lateral side and a second lateral side. A plurality of wheel mounts is attached to the housing and extends downwardly therefrom. A plurality of wheels is attached to the wheel mounts such that a pair of front wheels is defined and a pair of rear wheels is defined. A pair of handles is attached to the housing. A plurality of drive assemblies is mounted to the housing to control the housing. The drive assemblies include a propulsion drive mechanically coupled to at least one of the wheels to define a drive wheel. The propulsion drive is actuated to rotate the drive wheel in a first direction or a second direction. A direction drive is mechanically coupled to at least one of the wheels to define a directional wheel. The direction drive is actuated to rotate a rotational axis of the directional wheel left or right. An interface is mounted on the housing and electrically coupled to each of the drive assemblies to selectively actuate each of the drive assemblies. An actuator is electrically coupled to the processor.

BRIEF SUMMARY OF THE INVENTION

An embodiment of the disclosure meets the needs presented above by generally comprising a housing having a top wall, a bottom wall and a perimeter wall extending between and is attached to the top and bottom walls. The perimeter wall has a front side, a rear side, a first lateral side and a second lateral side. A plurality of wheel mounts is attached to the housing and extending downwardly therefrom. A plurality of wheels is attached to the wheel mounts such that a pair of front wheels is defined and a pair of rear wheels is defined. A pair of handles is attached to the housing. A plurality of drive assemblies is mounted to the housing to control the housing. The drive assemblies include a propulsion drive that is mechanically coupled to at least one of the wheels to define a drive wheel. The propulsion drive is actuated to rotate the drive wheel in a first direction or a second direction. A direction drive is mechanically coupled to at least one of the wheels to define a directional wheel. The direction drive is actuated to rotate a rotational axis of the directional wheel left or right. An interface is mounted on the housing and is electrically coupled to each of the drive assemblies to selectively actuate each of the drive assemblies.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
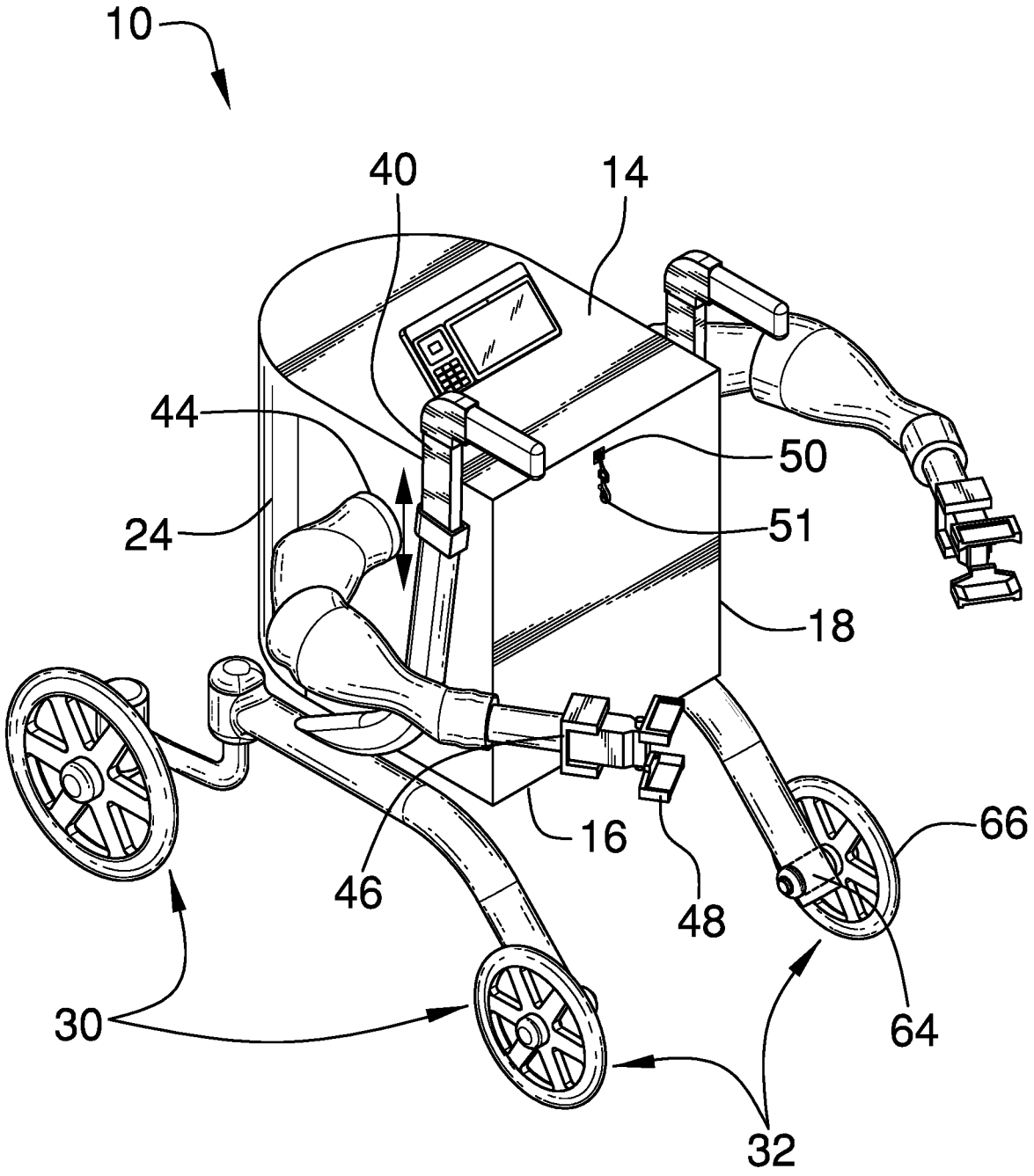
FIG. 1 is a rear isometric view of an automated walker assembly according to an embodiment of the disclosure.
Figure 2:
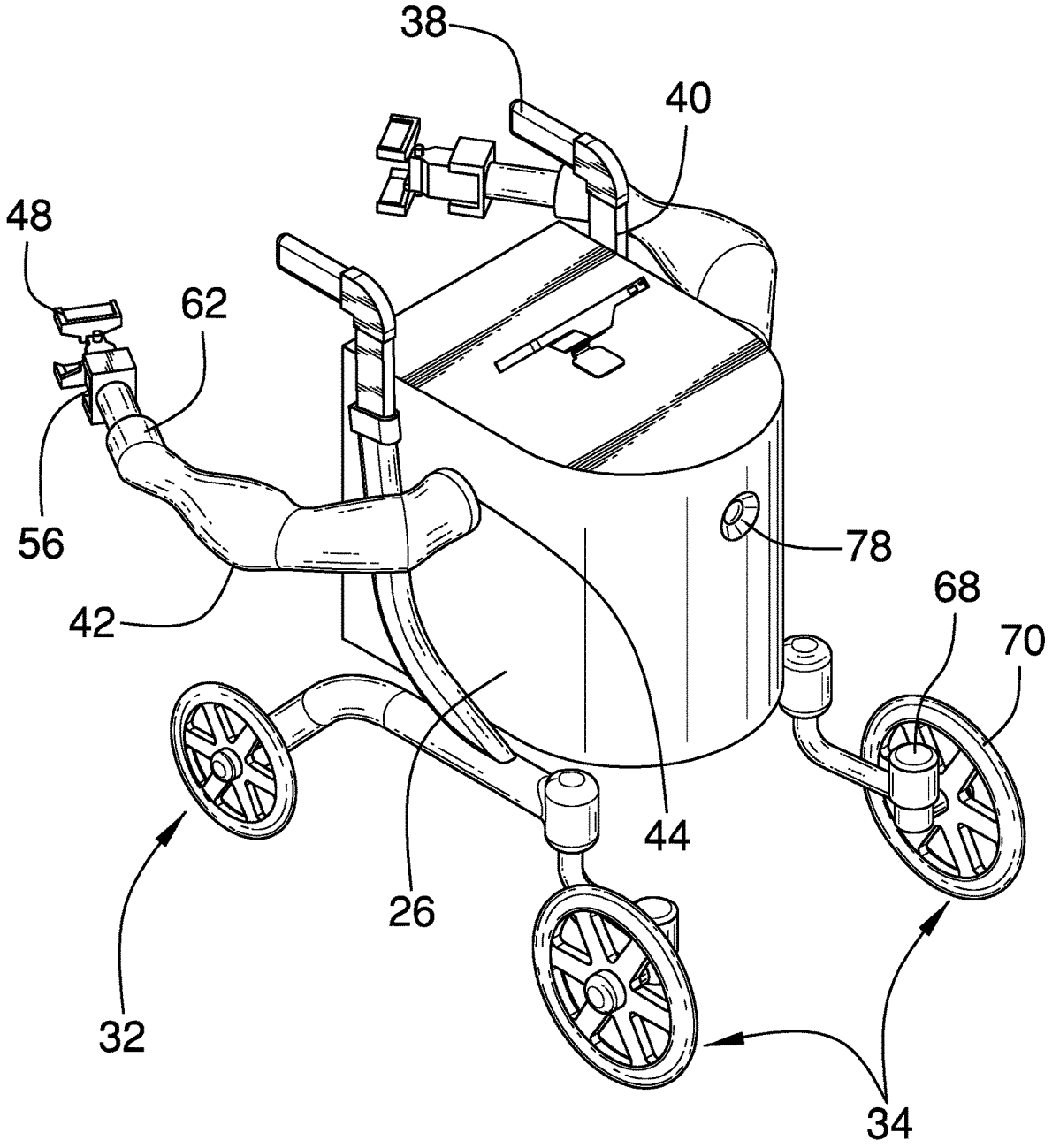
FIG. 2 is a front isometric view of an embodiment of the disclosure.

With reference now to the drawings, and in particular to FIGS. 1 through 7 thereof, a new walker device embodying the principles and concepts of an embodiment of the disclosure and generally designated by the reference numeral 10 will be described.

As best illustrated in FIGS. 1 through 7, the automated walker assembly 10 generally comprises a housing 12 that has a top wall 14, a bottom wall 16 and a perimeter wall 18 extending between and which is attached to the top 14 and bottom 16 walls. The perimeter wall 18 has a front side 20, a rear side 22, a first lateral side 24 and a second lateral side 26. The shape of the housing 12 is not central to its function, however a shape which is not conducive to being easily tipped over is preferred. However, an embodiment of the assembly 10 is envisioned which may utilize attached tilt sensors to allow for self-stabilization, known in the art, to ensure that the assembly 10 cannot easily tip over.

A plurality of wheel mounts 28 is attached to the housing 12 and extends downwardly therefrom. A plurality of wheels 30 is attached to the wheel mounts 28 such that a pair of front wheels 32 is defined and a pair of rear wheels 34 is defined. It should be noted that while only three wheels 30 may be used, the inclusion of a fourth wheel 30 allows for greater stability of the assembly 10. As noted above, the assembly 10 may utilize built in tilt sensors which would retain the assembly 10 in an upright position even if only two wheels were utilized. However, the usage of four wheels 30 will typically be preferred. Each of the wheel mounts 28 may include only one wheel as shown in the Figures, however, each wheel mount 28 may include up to two wheels 30 such that six or eight wheels 30 are utilized. Alternatively, there may be only two or three wheel mounts 28 wherein, for example, two wheel mounts 28 include a single wheel 30 and a third wheel mount 28 includes two wheels 30.

A pair of handles 36 is attached to the housing 12 and so that the handles 36 are laterally spaced from each other. Each of the handles 36 includes a grip 38 extending rearwardly of the housing 12. The handles 36 each include a post 40 attached to the housing 12 wherein the grips 38 are mounted on upper ends of the posts 40. The posts 40 may be vertically telescopic to allow a height of the grips 38, relative to a floor surface, be selectively lifted or lowered. The telescopic nature of the posts 40 may be accomplished with detent/notch combination or may be motorized.

Figure 3:
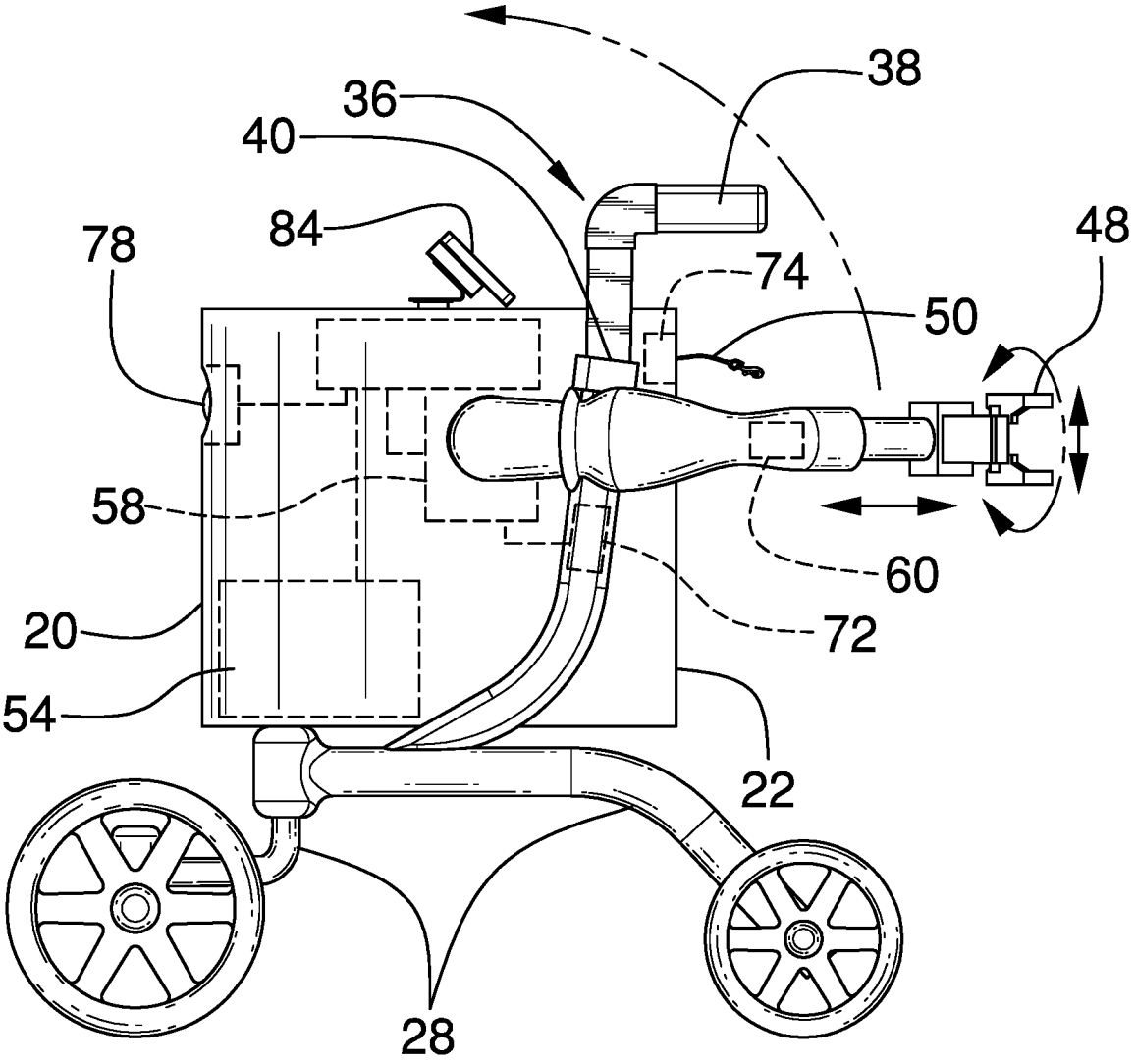
FIG. 3 is a side view of an embodiment of the disclosure.
Figure 4:
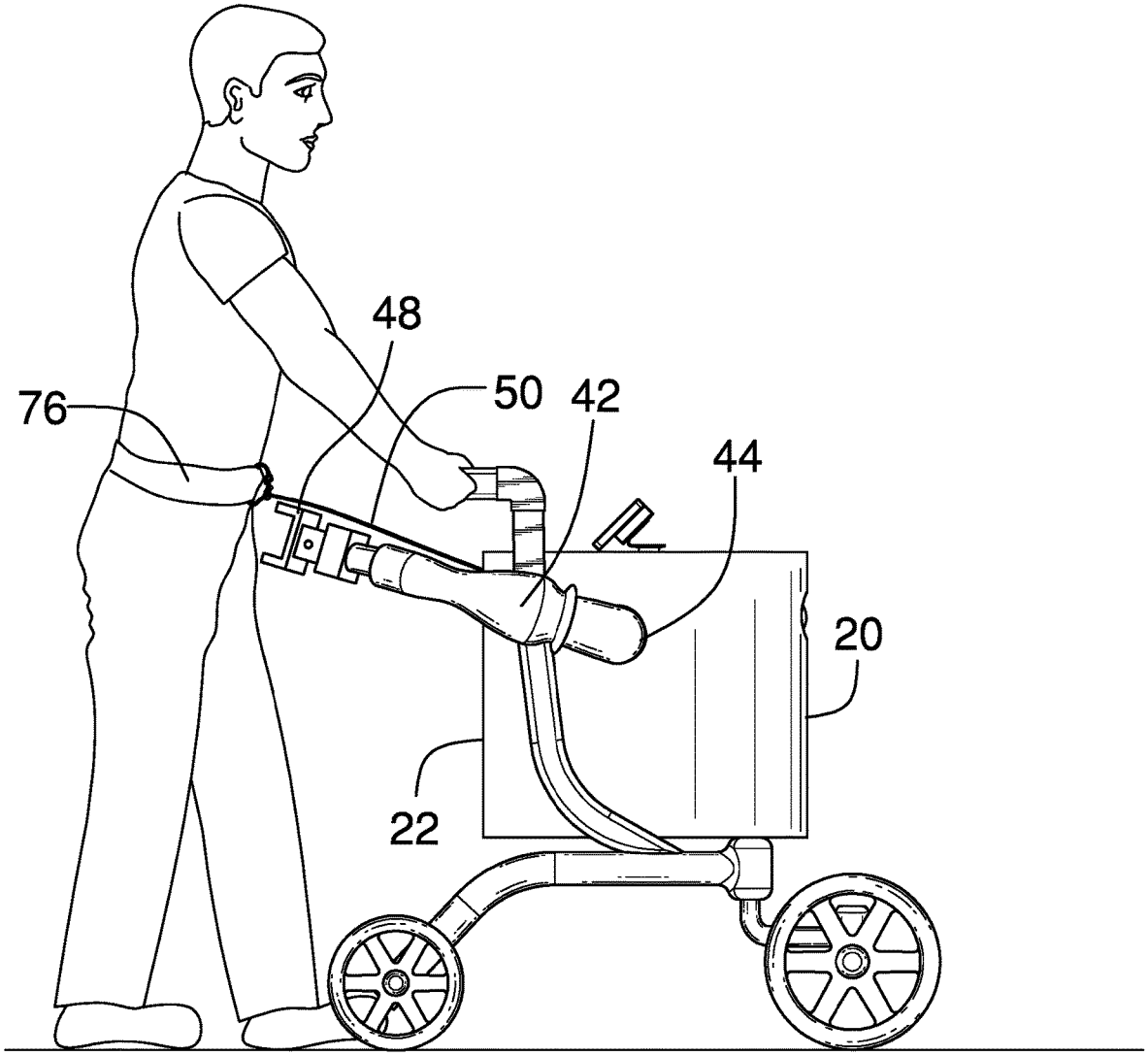
FIG. 4 is a side view of an embodiment of the disclosure.
Figure 5:
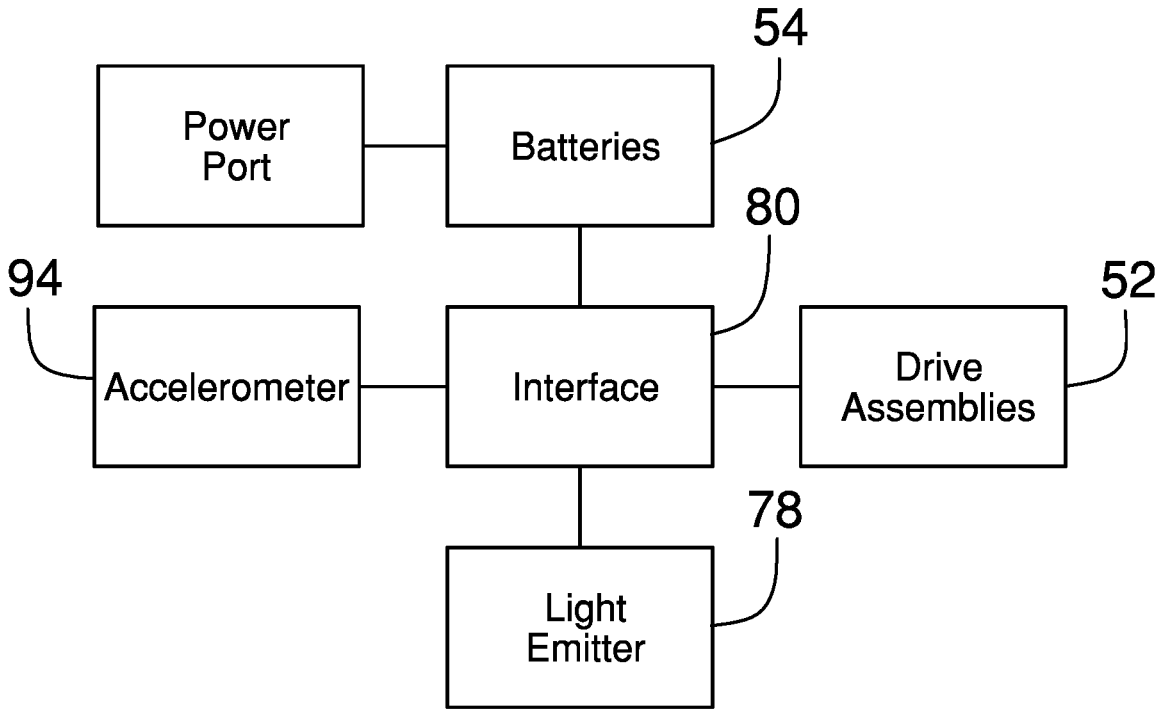
FIG. 5 is a schematic view of an embodiment of the disclosure.
Figure 6:
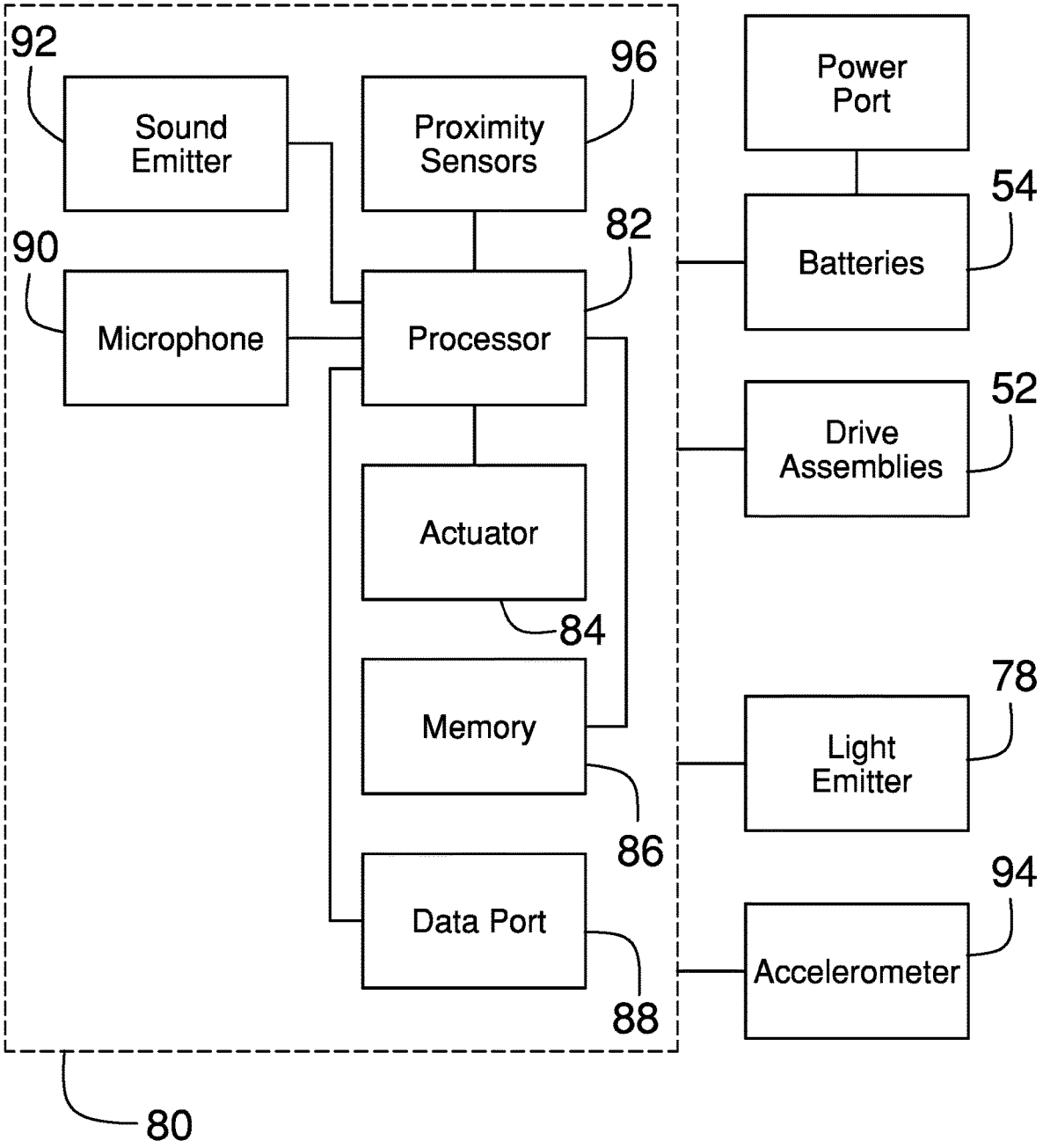
FIG. 6 is a schematic view of an embodiment of the disclosure.
Figure 7:
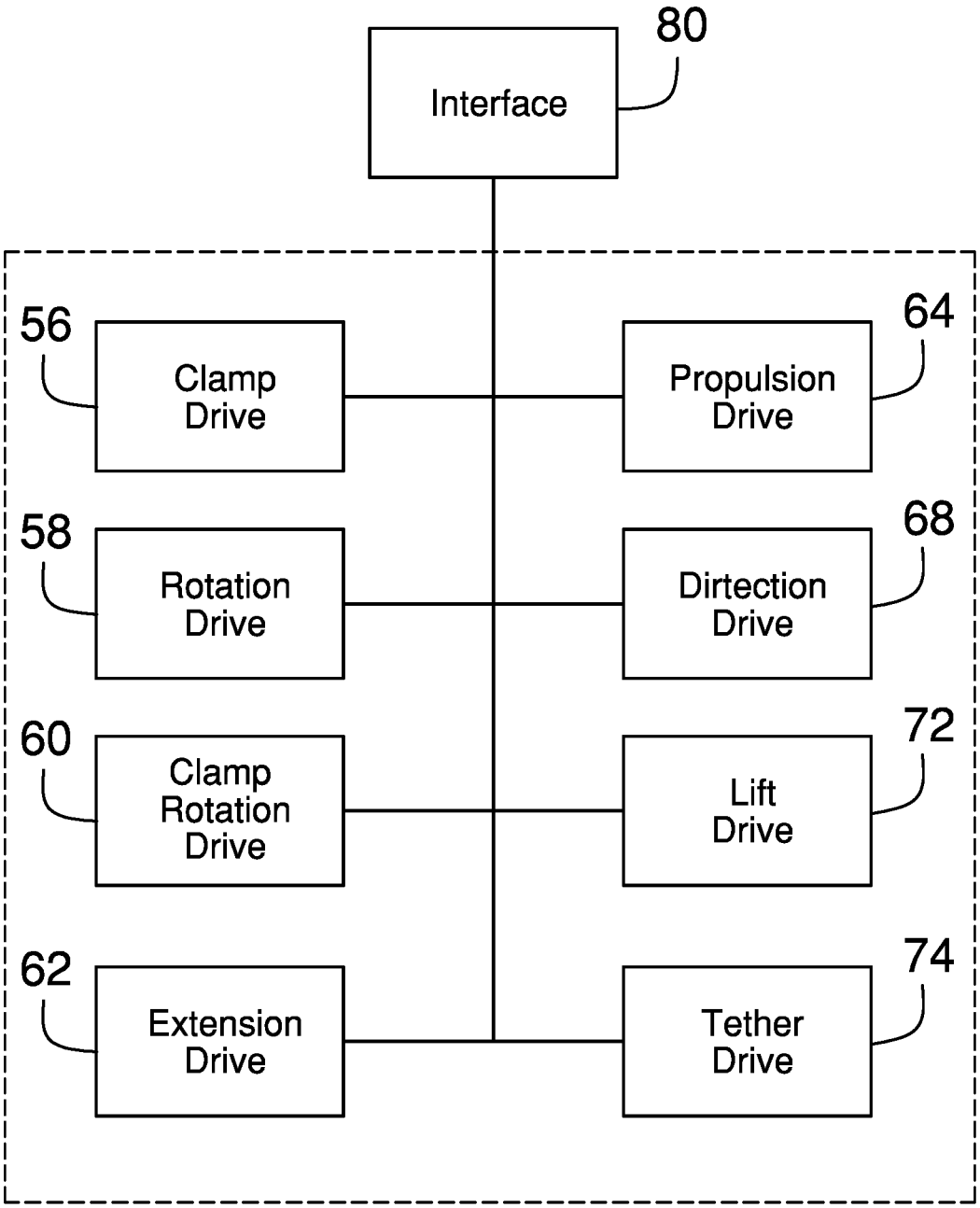
FIG. 7 is a schematic view of an embodiment of the disclosure.

A pair of arms 42 is attached to the housing 12. One of the arms 42 is attached to the first lateral side 24 and one of the arms 42 is attached to the second lateral side 26. Each of the arms 42 has an attached end 44 and a free end 46. The attached ends 44 are each pivotally attached to the housing 12 such that each of the free ends 46 are selectively positionable from and between positions extending rearwardly of the housing 12 to extending upwardly from the housing 12. The arms 42 are pivotal independent of each other allowing one arm 42 to be raised while the other is retained in a different position. A pair of clamping members 48 is provided and each of the free ends 46 has one the clamping members 48 attached thereto. The clamping members 48 allow the arms 42 to secure an object, such as a chair or a gait belt, to the housing 12. As can be seen in FIG. 3, each of the arms 42 may be telescopic to alter a length of the arm 42 while the clamping member 48 may be rotatable with respect to an attached one of the arms 42 to allow the orientation of the clamping member 48 to be altered as needed.

A tether 50 is mounted on the housing 12 and extends outwardly away from the rear side 22 of the housing 12. The tether has a terminal end comprising a coupler 51, such as for example a clip, configured to engage a gait belt or other object. The tether 50 is extendable outwardly from or retractable toward the housing 12. The tether 50 will typically extend no farther than 6 feet from the housing 12.

A plurality of drive assemblies 52 is provided to control each of the above structures. The drive assemblies 52 will typically be electric motors however, where feasible, an electric motor may be substituted for pneumatic or hydraulic pistons or by solenoids. Each drive assembly 52 is mounted to the housing 12 to control the movements of housing 12 and its various components. One or more batteries 54, typically rechargeable, will be mounted in the housing 12 to supply power the drive assemblies 52 and a power port electrically coupled thereto to recharge the batteries 54.

The drive assemblies 52 may include, for instance, a pair of clamp drives 56. Each of the clamp drives 56 is mechanically coupled to one of the clamping members 48. The clamp drives 56 are actuated to open or close the clamping members 48. The terms "open" and "close" further include the ability to adjust the amount each clamping member 48 is open between being fully opened or fully closed. The clamp drives 56 are actuated to close the clamping members 56 and frictionally engage an object when the clamping members 56 are positioned where needed to be able to engage a selected article such as a gait belt, edge of a chair, a bed trapeze or the like. A pair of rotation drives 58 is provided such that each of the arms 42 has one of the rotation drives 58 coupled thereto. The rotation drives 58 are actuated to rotate the arms 42 independently of each other between positions extending rearwardly of the housing 12 to extending upwardly from the housing 12. Together with clamp drives 56, the rotation drives 58 allow for the arms 40 to move as needed to grip a desired article. It should be understood that the arms 40 may further include three axis movement as opposed to two axis movement described above and would therefore require additional gearing and/or drives to allow lateral movement of the arms. The arms 42 may further include clamp rotational drives 60 to rotate the clamping member 48 as well as extension drives 62 to allow the arms 42 to be extended and retracted as needed.

A propulsion drive 64 is mechanically coupled to at least one of the wheels 30 to define a drive wheel 66. The propulsion drive 64 is actuated to rotate the drive wheel 66 in a first direction or a second direction. The drive wheel 66 is the primary means for moving the housing 12 across a floor or ground surface. It should be understood that two or more of the wheels 30 may include a propulsion drive 64 so that the drive wheels 66 work independently or in tandem with each other to move and turn the housing 12 as directed. A direction drive 68 is mechanically coupled to at least one of the wheels 30 to define a directional wheel 70. The direction drive 68 is actuated to rotate a rotational axis of the directional wheel 70 left or right. As with the propulsion drive, a plurality of the wheels 30 may include a directional drive 38 to allow for easier turning of the housing 12 and for the possibility that the housing 12 can rotate 360° in place. The drive 66 and direction 70 wheels may comprise either front 32 or rear 64 wheels.

The handles 36 are each coupled to one of a pair of lift drives 72 such that a height of the handles 36 relative to a floor may be altered by actuating the lift drives 72. This will allow adjustment of the grips 38 to the height of the various users of the assembly 10. The grips 38 are the primary location for a user of the assembly 10 to hold onto and be assisted by the housing 12. Thus, vertical height of the grips 38 is important to the user.

A tether drive 74 is mechanically coupled to the tether 50. The tether drive 74 is actuated to retract the tether 50 toward the housing 12. This may be used for two situations, in particular. The first is to assist a person in standing up by attaching the tether 74 to a gait belt 76 of a seated person. When actuated, the tether drive 74 may be used thereby to assist the person in standing upright by pulling them upwardly. The second is to prevent a person from falling down wherein the tether drive 74 includes a fall detection sensor whereby the tether drive 74 is turned should a sudden increase in drag be detected on the tether drive 74.

A light emitter 78 is mounted on the housing 12 and emits light when the light emitter is actuated to a powered condition. The light emitter 78 is mounted on the front side 22 of the housing 12 and is directed forward of the housing 12. The light emitter 78 may include one or more light emitting diodes countersunk into the front side 22 of the housing 12.

An interface 80 is mounted on the housing 12 and is electrically coupled to each of the drive assemblies 52 and to the light emitter 78 to control each. The interface 80 includes a conventional processor 82 and an actuator 84 is electrically coupled to the processor. Electronic memory 86 will be mounted on the housing 12 and electrically coupled to the processor 82. The actuator 84 may include any conventional input structure including a touch screen, keyboard, switches and the like. Data ports 88 may be electrically coupled to the processor 82 and mounted on the interface or to the housing 12, in general, to program or modify the programming for the processor 82 as needed. A microphone 90 is electrically coupled to the processor 82, to act as yet another actuator/input, wherein the processor 82 is configured to receive voice commands detected by the microphone 90 which in turn allows the processor 82 to actuate the drive assemblies 52 and light emitter 78 based on the voice commands. One or more sound emitters 92 may be utilized for allowing communication between a user and the assembly 10 as well as allowing the assembly 10 to be used as for internet inquiries, playing of music and like.

An accelerometer 94 is mounted on the housing and is electrically coupled to the interface 80. The accelerometer 94 is configured to detect a threshold acceleration event caused by a person falling while gripping or being secured to the housing 12. The interface 80 actuates the drive assemblies 52 to create a counteraction event to counteract the threshold acceleration event. The threshold acceleration event may need to be determined once the parameters of the user are established based upon weight, height and typical walking speed. However, as an example, if the accelerometer 94 detects an acceleration forward or backward of the housing being greater than 5.0 $m/s^2$ or less than −5.0 $m/s^2$, there may be an indication that the user of the assembly 10 is falling forward or backward and pushing/pulling the housing 12 with them. In such an instance the propulsion drives 64 may be actuated to either counteract the movement by causing rotation of the drive wheel(s) 66 in the opposite direction or by locking the drive wheel(s) 66 from rotation so that the housing 12 remains stationary. The propulsion drives 64 may be utilized as braking systems though active brakes may be mounted on the assembly 10 and be engageable with the wheels 30 to mechanically lock movement of the wheels 30 as needed.

A proximity sensor 96, or multiple ones thereof, may be mounted on the housing 12 and be electrically coupled to the processor 82 to allow the processor 84 to determine if objects are positioned adjacent to the housing 12 which may cause interference with the movement of the housing 12. If a user of the assembly 10 uses a voice command to call the housing 12 to move to the user, the proximity sensor 96 will ensure that the assembly 10 does not interact in an unintended manner with other objects and may also be used to locate the user.

In use, the assembly 10 is used as a conventional walker but with features to better assist a person who is alone and requires additional assistant while rising to stand, sit up from a bed, or get up from the floor such as after a fall. As such, the assembly 10 includes various features not common to a traditional walker. These include, for example, the tether 50 which can be attached to a gait belt 76 for the purpose of assisting a person to rise by reeling in the tether 50 and by preventing the person from falling by locking the tether 50 should a sudden amount of drag be detected on the tether 50. The arms 42 and clamping members 48 are used in various ways such as gripping onto a chair, bed, and/or trapeze to stabilize the assembly 10 relative to the user. For example, if a person is seated in a chair, the clamping members 48 may engage the seat, legs or armrests of the chair so that the chair cannot move while the person is standing up. Furthermore, the clamping members 48 may be secured onto the gait belt 76 to prevent the user from falling while they walk. The propulsion drives 64 are used to help the person move and control speed of movement, if needed, but also to allow the assembly 10 be self propelled so that it can move to the person should the person require the assembly 10 to travel toward the person. It should further be understood that the assembly 10 may be used in a passive manner such that the wheels 30 are allowed to rotate freely when a user is utilizing the assembly 10 for walking purposes.

The microphone 90 allows for voice commands to direct the assembly 10, e.g. forward, reverse, rotate left, rotate right, etc. Thus if the person should fall, they can direct the assembly 10 to them. The assembly 10 may include proximity sensors 96 to avoid objects in its path and which may further track a tracker in wireless communication with the processor wherein the user holds or wears the tracker so that the assembly 10 can locate and propel itself to the tracker should the user call out to the assembly 10 or utilize an emergency word such as "help" or the like. The microphone 90 further allows the user to use voice commands to control all other aspects of the assembly 10 including the arms 42 as needed. Further, the interface 80, by way of the microphone 90 or other actuator 84, may be used to increase the speed of the propulsion drive 64. The ability to direct a motorized and mobile device is well known in the electronic and toy arts.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A walking assistance apparatus comprising:

a housing having a top wall, a bottom wall and a perimeter wall extending between and being attached to said top and bottom walls, said perimeter wall having a front side, a rear side, a first lateral side and a second lateral side;

a plurality of wheel mounts being attached to said housing and extending downwardly therefrom;

a plurality of wheels being attached to said wheel mounts such that a pair of front wheels is defined and a pair of rear wheels is defined;

a pair of handles being attached to said housing;

a plurality of drive assemblies being mounted to said housing to control said housing, said drive assemblies including:

a propulsion drive being mechanically coupled to at least one of said wheels to define a drive wheel, said propulsion drive being actuated to rotate said drive wheel in a first direction or a second direction;

a direction drive being mechanically coupled to at least one of said wheels to define a directional wheel, said direction drive being actuated to rotate a rotational axis of said directional wheel left or right;

an interface being mounted on said housing and electrically coupled to each of said drive assemblies to selectively actuate each of said drive assemblies; and an accelerometer being mounted on said housing and being electrically coupled to said interface, said accelerometer being configured to detect a threshold acceleration event caused by a person falling while gripping said housing, said interface actuating said drive assemblies to create a counteraction event to counteract said threshold acceleration event.

2. The walking assistance apparatus according to claim 1, further including:

a pair of arms being attached to said housing, one of said arms being attached to said first lateral side and one of said arms being attached to said second lateral side, each of said arms having an attached end an a free end, each of said attached ends being pivotally attached to said housing such that each of said free ends is selectively positionable from and between positions extending rearwardly of said housing to extending upwardly from said housing; and a pair of clamping members, each of said free ends having one said clamping members attached thereto.

3. The walking assistance apparatus according to claim 1, further including a tether being mounted on said housing and extending outwardly away from said rear side of said housing, said tether having a terminal end comprising a coupler configured to engage a gait belt, said tether being extendable outwardly from or retractable toward said housing.

4. The walking assistance apparatus according to claim 3, wherein said drive assemblies include a tether drive being mechanically coupled to said tether, said tether drive being actuated to retract said tether toward said housing.

5. The walking assistance apparatus according to claim 1, further including a light emitter being mounted on said housing and emitting light when said light emitter is actuated to a powered condition, said light emitter being mounted on said front side of said housing and being directed forward of said housing, said light emitter being electrically coupled to said interface, said light emitter being actuated on or off by said interface.

6. The walking assistance apparatus according to claim 1, wherein said interface includes:

a processor;

an actuator electrically coupled to said processor;

a microphone electrically coupled to said processor, said processor being configured to receive voice commands detected by said microphone;

said processor being configured to receive voice commands to actuate said drive assemblies.

7. A walking assistance apparatus comprising:

a housing having a top wall, a bottom wall and a perimeter wall extending between and being attached to said top and bottom walls, said perimeter wall having a front side, a rear side, a first lateral side and a second lateral side;

a plurality of wheel mounts being attached to said housing and extending downwardly therefrom;

a plurality of wheels being attached to said wheel mounts such that a pair of front wheels is defined and a pair of rear wheels is defined;

a pair of handles being attached to said housing, said handles are laterally spaced from each other and each of said handles includes a grip extending rearwardly of said housing, said handles each including a post attached to said housing wherein said grips are mounted on upper ends of said posts, each of said posts being vertically telescopic; and a plurality of drive assemblies being mounted to said housing to control said housing, said drive assemblies including:

a propulsion drive being mechanically coupled to at least one of said wheels to define a drive wheel, said propulsion drive being actuated to rotate said drive wheel in a first direction or a second direction; and a direction drive being mechanically coupled to at least one of said wheels to define a directional wheel, said direction drive being actuated to rotate a rotational axis of said directional wheel left or right; and an interface being mounted on said housing and electrically coupled to each of said drive assemblies to selectively actuate each of said drive assemblies.

8. The walking assistance apparatus according to claim 7, wherein said plurality of drive assemblies includes a pair of lift drives, each of said handles having one of said lift drives coupled thereto such that a height of said handles relative to a floor may be altered by actuating the lift drives.

9. A walking assistance apparatus comprising:

a housing having a top wall, a bottom wall and a perimeter wall extending between and being attached to said top and bottom walls, said perimeter wall having a front side, a rear side, a first lateral side and a second lateral side;

a plurality of wheel mounts being attached to said housing and extending downwardly therefrom;

a plurality of wheels being attached to said wheel mounts such that a pair of front wheels is defined and a pair of rear wheels is defined;

a pair of handles being attached to said housing;

a plurality of drive assemblies being mounted to said housing to control said housing, said drive assemblies including:

a propulsion drive being mechanically coupled to at least one of said wheels to define a drive wheel, said propulsion drive being actuated to rotate said drive wheel in a first direction or a second direction;

a direction drive being mechanically coupled to at least one of said wheels to define a directional wheel, said direction drive being actuated to rotate a rotational axis of said directional wheel left or right; and a pair of arms being attached to said housing, one of said arms being attached to said first lateral side and one of said arms being attached to said second lateral side, each of said arms haying an attached end an a free end, each of said attached ends being pivotally attached to said housing such that each of said free ends is selectively positionable from and between positions extending rearwardly of said housing to extending upwardly from said housing;

a pair of rotation drives, each of said arms having one of said rotation drives coupled thereto, said rotation drives being actuated to rotate said arms independently of each other between positions extending rearwardly of said housing to extending upwardly from said housing; and a pair of clamping members, each of said free ends having one said clamping members attached thereto; and an interface being mounted on said housing and electrically coupled to each of said drive assemblies to selectively actuate each of said drive assemblies.

10. The walking assistance apparatus according to claim 9, wherein said drive assemblies include a pair of clamp drives, each of said clamp drives being mechanically coupled to one of said clamping members, said clamp drives being actuated to open or close said clamping members.

11. The walking assistance apparatus according to claim 10, further including a tether being mounted on said housing and extending outwardly away from said rear side of said housing, said tether having a terminal end comprising a coupler configured to engage a gait belt, said tether being extendable outwardly from or retractable toward said housing.

12. The walking assistance apparatus according to claim 11, wherein said drive assemblies include a tether drive being mechanically coupled to said tether, said tether drive being actuated to retract said tether toward said housing.

13. The walking assistance apparatus according to claim 12, wherein said handles are laterally spaced from each other and each of said handles includes a grip extending rearwardly of said housing, said handles each including a post attached to said housing wherein said grips are mounted on upper ends of said posts, each of said posts being vertically telescopic.

14. The walking assistance apparatus according to claim 13, wherein said plurality of drive assemblies includes a pair of lift drives, each of said handles having one of said lift drives coupled thereto such that a height of said handles relative to a floor may be altered by actuating the lift drives.

15. The walking assistance apparatus according to claim 14, wherein said interface includes:

a processor;

an actuator electrically coupled to said processor;

a microphone electrically coupled to said processor, said processor being configured to receive voice commands detected by said microphone;

said processor being configured to receive voice commands to actuate said drive assemblies.

16. The walking assistance apparatus according to claim 15, further including an accelerometer being mounted on said housing and being electrically coupled to said interface, said accelerometer being configured to detect a threshold acceleration event caused by a person falling while gripping said housing, said interface actuating said drive assemblies to create a counteraction event to counteract said threshold acceleration event.

17. A walking assistance apparatus comprising:

said handles being laterally spaced from each other and each of said handles including grips extending rearwardly of said housing, said handles each including a post attached to said housing wherein said grips are mounted on upper ends of said posts, each of said posts being vertically telescopic;

a pair of arms being attached to said housing, one of said arms being attached to said first lateral side and one of said arms being attached to said second lateral side, each of said arms having an attached end an a free end, each of said attached ends being pivotally attached to said housing such that each of said free ends is selectively positionable from and between positions extending rearwardly of said housing to extending upwardly from said housing;

a pair of clamping members, each of said free ends having one said clamping members attached thereto;

a tether being mounted on said housing and extending outwardly away from said rear side of said housing, said tether having a terminal end comprising a coupler configured to engage a gait belt, said tether being extendable outwardly from or retractable toward said housing;

said drive assemblies including:

a pair of clamp drives, each of said clamp drives being mechanically coupled to one of said clamping members, said clamp drives being actuated to open or close said clamping members;

a pair of rotation drives, each of said arms having one of said rotation drives coupled thereto, said rotation drives being actuated to rotate said arms independently of each other between positions extending rearwardly of said housing to extending upwardly from said housing;

a pair of lift drives, each of said handles having one of said lift drives coupled thereto such that a height of said handles relative to a floor may be altered by actuating the lift drives;

a tether drive being mechanically coupled to said tether, said tether drive being actuated to retract said tether toward said housing;

a light emitter being mounted on said housing and emitting light when said light emitter is actuated to a powered condition, said light emitter being mounted on said front side of said housing and being directed forward of said housing;

said interface being electrically coupled to said light emitter, said interface including:

a processor;

an actuator electrically coupled to said processor;

a microphone electrically coupled to said processor, said processor being configured to receive voice commands detected by said microphone; and said processor being configured to receive voice commands to actuate said drive assemblies.

* * * * *